US012178261B2

(12) United States Patent
Yamagata

(10) Patent No.: US 12,178,261 B2
(45) Date of Patent: Dec. 31, 2024

(54) CARE UNDERWEAR AND MANUFACTURING METHOD OF CARE UNDERWEAR

(71) Applicant: Takumi Yamagata, Okayama (JP)

(72) Inventor: Takumi Yamagata, Okayama (JP)

( * ) Notice: Subject to any disclaimer, the term of this patent is extended or adjusted under 35 U.S.C. 154(b) by 0 days.

(21) Appl. No.: 18/416,426

(22) Filed: Jan. 18, 2024

(65) Prior Publication Data

US 2024/0245144 A1 Jul. 25, 2024

(30) Foreign Application Priority Data

Jan. 25, 2023 (JP) ..... 2023-009572

(51) Int. Cl.
*A41B 9/00* (2006.01)

(52) U.S. Cl.
CPC ..... *A41B 9/001* (2013.01); *A41B 2300/32* (2013.01)

(58) Field of Classification Search
CPC ..... A41D 9/001; A41B 2300/32
USPC ..... 2/78.1–78.4, 114
See application file for complete search history.

(56) References Cited

U.S. PATENT DOCUMENTS 2,618,266 A * 11/1952 De Leone ..... A41B 13/04 2/238
4,145,763 A * 3/1979 Abrams ..... A41D 13/129 2/403
4,675,918 A * 6/1987 O'Brien ..... A41B 9/007 2/919
5,315,713 A * 5/1994 Pileggi ..... A41D 25/003 24/66.4
D510,791 S * 10/2005 Nathan-Kohan ..... D2/712
7,000,261 B1 * 2/2006 Loffredo ..... A61F 5/449 2/400
8,087,098 B2 * 1/2012 Kimberly ..... A41B 9/001 2/403
8,214,927 B1 * 7/2012 Jondahl ..... A41D 13/0525 2/22
D677,447 S * 3/2013 Shoemaker ..... A41B 9/001 D2/712
D679,070 S * 4/2013 Denning ..... D2/712
D683,519 S * 6/2013 Denning ..... D2/712
D1,020,179 S * 4/2024 Ramos ..... D2/742
2015/0020287 A1 * 1/2015 Liu ..... A41B 9/001 2/69

FOREIGN PATENT DOCUMENTS

JP 2-132602 U 11/1990
JP 06-033904 U 5/1994
(Continued)

OTHER PUBLICATIONS

Notice of Reasons for Refusal issued in corresponding Japanese Patent Application No. 2023-009572, Aug. 15, 2023, 10 pages w/translation.

*Primary Examiner* — Gloria M Hale
(74) *Attorney, Agent, or Firm* — HSML P.C.

(57) ABSTRACT

A care underwear includes a first body and a second body connected to the first body. The care underwear has a front surface and a back surface. During use, the front surface is exposed to the outside and the back surface is hidden on a body side. The first body has projecting portions that project laterally, and each of the projecting portions is provided with a boundary connecting portion that is connected to a back surface of the second body.

9 Claims, 8 Drawing Sheets

(56) References Cited

FOREIGN PATENT DOCUMENTS

| | | | |
|---|---|---|---|
| JP | 3172651 | B | 6/2001 |
| JP | 3080117 | U | 9/2001 |
| JP | 3097960 | U | 2/2004 |
| JP | 3138427 | U | 1/2008 |
| JP | 2008-111215 | A | 5/2008 |
| JP | 2010-070864 | A | 4/2010 |
| JP | 2019-183339 | A | 10/2019 |

* cited by examiner

CARE UNDERWEAR AND MANUFACTURING METHOD OF CARE UNDERWEAR

BACKGROUND

Technical Field

The present invention relates to underwear used to reduce a work load when performing care.

Related Art

In Japan, a demand for care is greatly increasing in super-aged society, and a burden on a person who performs care is very large. For example, when a care receiver has incontinence in underwear, the care receiver has to raise his/her foot to take off the underwear, and it takes a lot of time and effort to handle the underwear.

On the other hand, in order to facilitate an attachment and detachment of the underwear, the underwear that can be attached and detached without raising the foot as in Patent Document 1 and Patent Document 2 is proposed.

Patent Document 1: JP 2019-183339 A

Patent Document 2: JP 2010-70864 A

SUMMARY

On the other hand, in the underwear described in Patent Document 1 and Patent Document 2, since an attachment portion is pulled and attached to an outer side of a body, an appearance looks like a general diaper. Such a form may humiliate a care receiver, and then the care receiver may refuse to wear underwear, greatly increasing the burden of care.

In view of the above problems, an object of the present invention is to provide care underwear that can have an appearance equivalent to an appearance of the underwear and has high convenience in care and high comfort for the care receiver.

The present invention to solve the above problems is care underwear including a first body and a second body connected to the first body, the care underwear having a front surface exposed to the outside during use and a back surface hidden on a body side, wherein the first body has projecting portions projecting laterally, and each of the projecting portions is provided with a connection means connected to a back surface of the second body.

As a result, since the projecting portion can be hidden, it is possible to provide comfortable care underwear that does not humiliate the user as if he/she is wearing a diaper while maintaining an appearance similar to an appearance of normal underwear.

In a preferred mode of the present invention, the connection means includes a boundary connecting portion provided adjacent to a boundary line between the first body and the projecting portion.

As a result, the connection means can be easily positioned, and the front and back can be appropriately used, therefore convenience for the caregiver can be enhanced.

In a preferred mode of the present invention, the boundary connecting portion is a belt-shaped member.

This makes it possible to facilitate adjustment of positioning while maintaining a strength of the connection means.

In a preferred mode of the present invention, the connection means further includes a belt-shaped end connecting portion provided along an upper end of the projecting portion, and the end connecting portion and the boundary connecting portion are provided apart from each other.

With such a configuration, even if a wearer moves, the connection means is less likely to get off, and discomfort of the user can be reduced.

In a preferred mode of the present invention, the connection means is a hook-and-loop fastener, and a connected portion corresponding to the hook-and-loop fastener is provided at a predetermined position of the second body.

This can facilitate an attachment of the connection means.

In a preferred mode of the present invention, the projecting portion covers a connected means in a state where the connection means is connected. This can reduce discomfort during wearing.

In a preferred mode of the present invention, at least one of the first body and the second body has a side surface edge which is an edge of an end portion and a window portion through which a penis can be exposed, and a distance from the side surface edge to the window portion is longer than a distance from the boundary connecting portion to a projecting end edge of the projecting portion. Thus, a feeling of usage is equivalent to the feeling of usage of normal underwear without hindering the use of the window portion.

The present invention is a method for manufacturing care underwear including a first body and a second body connected to the first body, wherein the first body has projecting portions projecting laterally, and each of the projecting portions is provided with a connection means connected to a back surface of the second body on the front surface, the method including a cutting step of cutting a side portion of the underwear; and a joining step of joining the projecting portions to the first body.

As a result, it is possible to divert the appearance of the conventional underwear to the appearance of the care underwear without impairing the appearance, and it is possible to reduce the user's humiliation.

The present invention to solve the above problems can provide care underwear that can have an appearance and comfort equivalent to the appearance and comfort of normal underwear and has highly convenience in care.

DETAILED DESCRIPTION

Hereinafter, care underwear X according to each embodiment of the present invention will be described with reference to the drawings. The description will be given in detail in the order of configurations of embodiments, implementation methods, and other examples.

The following embodiments are examples of the present invention, and the present invention is not limited to the following embodiments.

First Embodiment

The care underwear X includes a first body 1 having a top edge positioned at a waist of a user and covering a crotch on an abdomen side or a dorsal side of the user during use, a second body 2 having a top edge positioned at the waist of the user and covering the crotch of the user on a side not covered by the first body 1 during use, and a crotch pad 3 connecting the first body 1 and the second body 2.

Figure 1:
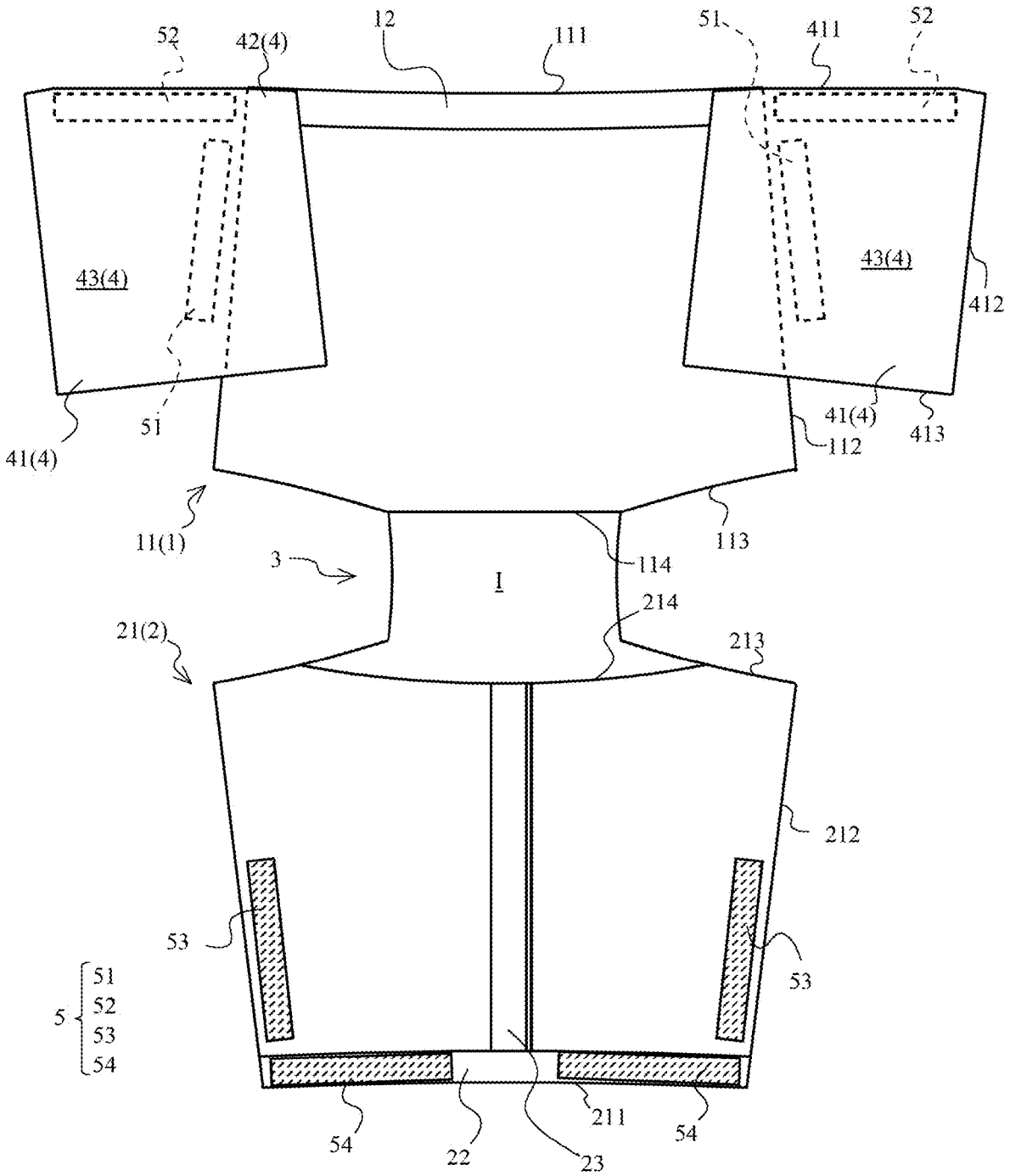
FIG. 1 is a developed view of care underwear expanded on a back surface according to a first embodiment of the present invention.
Figure 2:
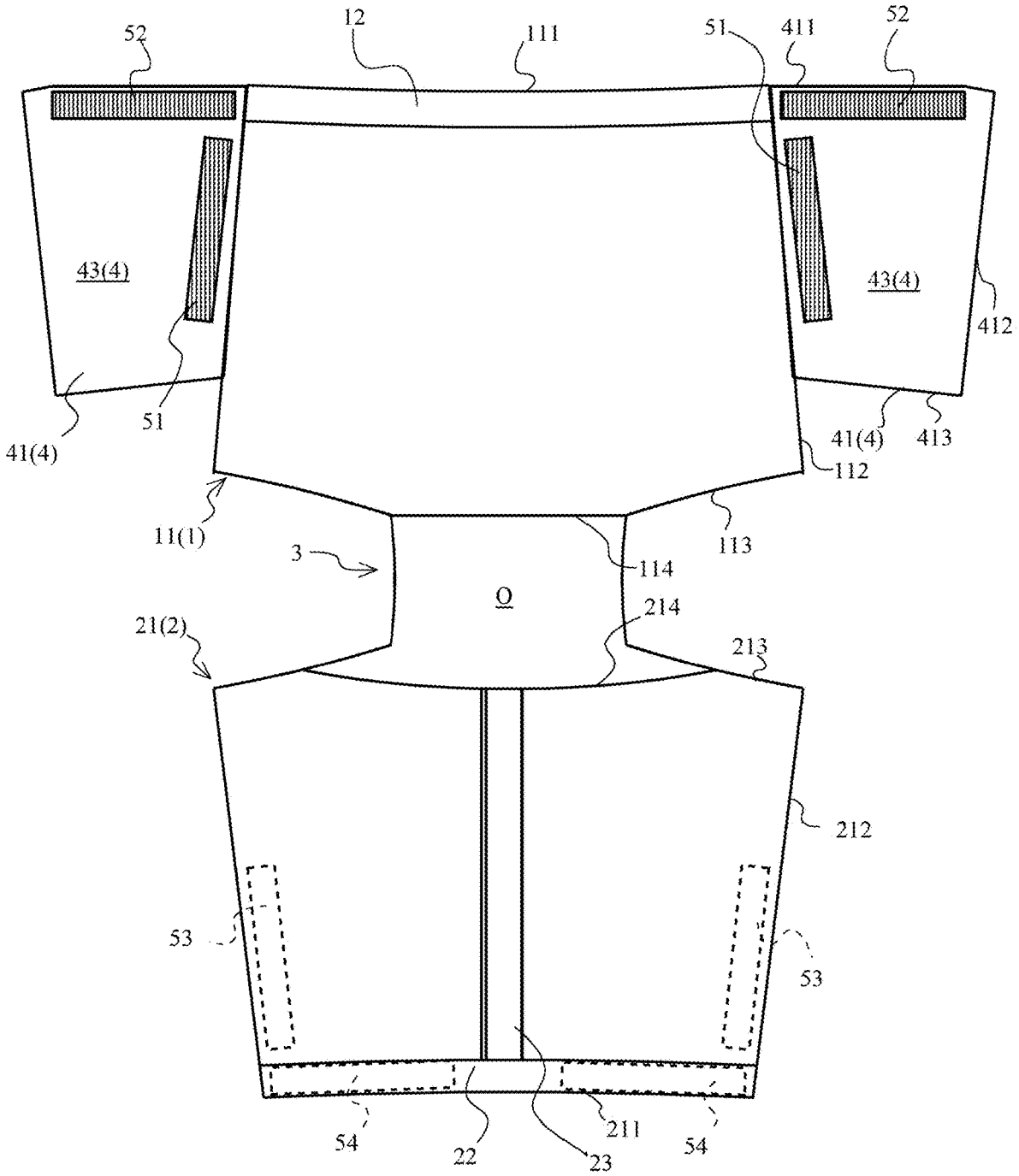
FIG. 2 is a developed view of the care underwear expanded on a front surface according to the first embodiment of the present invention.

In the embodiment shown in FIGS. 1 and 2, the first body 1 covers the crotch on the dorsal side, and the second body 2 covers the crotch on the abdomen side, but this may be reversed.

The first body 1, the second body 2, and the crotch pad 3 have a front surface O that abuts with a body of the user when used in a first use method described later, and a back surface I exposed to an outside of the user. For convenience, a direction in which the front surface O exists is referred to as a front surface side, and a direction in which the back surface I exists is referred to as a back surface side.

The first body 1 includes a first body main body 11 that covers the user during use, and an elastic portion 12 that is provided adjacent to the top edge of the first body main body 11 and holds a waist of the user.

The first body main body 11 is a cloth material having a substantially trapezoidal shape, and is formed with nylon, cotton, or the like. A periphery of the first body main body 11 has a top edge 111 positioned on the waist at during use, a side surface edge 112 extending downward from the top edge, a foot projecting edge 113 that the user can put his/her foot out, and a connection edge 114 connected to the crotch pad 3.

Further, a projecting portion 4 is provided so as to project laterally from the side surface edge 112.

The elastic portion 12 is a rubber string member provided adjacent to the top edge 111, and can hold the care underwear at a predetermined position of the waist of the user by expanding and contracting.

The second body 2 includes a second body main body 21 that covers the user during use, a second elastic portion 22 that is provided adjacent to the top edge of the second body main body 21 and holds the waist of the user, and a window portion 23 that can expose a penis and penetrates the second body main body 21.

Structures of the second body main body 21 and the second elastic portion 22 are substantially identical to structures of the first body main body 11 and the elastic portion 12 respectively, the second body main body 21 has a second top edge 211, a second side surface edge 212, a second foot projecting edge 213, and a second connection edge 214. On the other hand, no component corresponding to the projecting portion 4 is provided.

The window portion 23 is a hole penetrating the second body main body 21, and is formed for an opening to be visually recognized from the outside by pushing and expanding an overlapping portion of the second body main body 21. The window portion is formed substantially at the center in the side direction.

The crotch pad 3 is a member stretched between the connection edge 114 and the second connection edge 214, and may be provided with a reinforcing member such as cloth in order to increase strength. In addition, a water-absorbent member may be provided in preparation for the case where the user has incontinence, and the member may be provided on both surfaces of the crotch pad 3 in preparation for a use method to be described later.

Each of the projecting portions 4 is a cloth material that is symmetrically provided to extend laterally from the side surface edge 112 and cut out in a substantially quadrangular shape, and is formed of nylon or cotton. The projecting portion 4 includes a projecting portion main body 41 that projects laterally, an overlapping portion 42 that abuts on the first body main body 11 inside the side surface edge 112, and a sliding portion 43 that can slide on the second body in an attached state.

A color of the projecting portion 4 is preferably at least a color different from a color of the first body 1, and it is particularly preferable to use a conspicuous color such as orange or yellow. As a result, a caregiver can easily visually recognize a position of the projecting portion 4 and can easily attach the same to the user.

The projecting portion main body 41 is a member that projects from the side surface edge 112 of the first body main body 11 and extends in a substantially quadrangular shape, and is provided to cover from an end portion on a top end edge side of the side surface edge 112 to a middle portion on a foot insertion side edge side. It is preferable to cover ⅕ to ⅘ from the end portion on the top end edge side of the side surface edge 112. Since the portion of the foot insertion is wider, the caregiver can easily insert the foot of the user, and the user can easily move.

An outer edge of the projecting portion main body 41 includes a projecting extension edge 411 provided to be an extension line of the top end edge, a projecting end edge 412 facing the side surface edge 112, and a projecting bottom edge 413 extending from the projecting end edge 412 toward the side surface edge 112. Corner portions may be appropriately chamfered.

In addition, an area of the projecting portion main body 41 is provided to be smaller than at least a half of an area of the second body 2, and is preferably provided such that a portion projecting from the second body 2 is eliminated when the projecting portion main body 41 is placed on the second body 2 such that the side surface edge 112 and the second side surface edge 212 are overlapped. Thus, the appearance can be similar to an appearance of normal underwear.

The overlapping portion 42 is a portion overlapping the first body main body 11 in the projecting portion 4, and here, the first body 1 and the projecting portion 4 are connected. Various means such as stitching, bonding, and buttoning can be considered as a connection method, it is preferable to connect the edges of the overlapping portion 42 closely.

In the embodiment, each of the overlapping portions 42 is connected on the back surface side of the care underwear, but may be connected on the front surface side.

The sliding portion 43 is a substantially triangular region connecting the projecting end edge 412 and the projecting bottom edge 413, and since a vicinity of the edge is not connected to the body or the like, the sliding portion slides when abutting on the second body 2. Surface treatment for reducing friction may be performed such that the sliding portion 43 is slippery against the second body 2 when abutting on the second body 2. Preferably, a friction force generated between the second body 2 and the projecting portion 4 is larger than a friction force acting between a skin of the user and the projecting portion 4. By sliding the sliding portion 43, the caregiver can easily make the user wear the care underwear.

In addition, since a distance from the projecting end edge 412 to the side surface edge 112 is provided to be shorter than a distance from the second side surface edge 212 to the window portion 23, a use of the window portion is not hindered during use.

A connection means 5 includes a boundary connecting portions 51 and an end connecting portions 52 provided on the front surface side of the projecting portion 4, and boundary connected portions 53 and end connected portions 54 provided on the back surface side of the second body 2.

Here, it is assumed that a hook-and-loop fastener is used as the connection means 5, but various means such as a zipper or an attachment button may be used.

The boundary connecting portion 51 is a hook-and-loop fastener provided along the direction that the side surface edge 112 extends in a vicinity of the side surface edge 112 on the front surface side of the projecting portion main body 41.

The boundary connecting portion 51 is provided to be apart from the projecting bottom edge 413, and widens a range of the sliding portion 43 that the projecting portion can slide.

The end connecting portion 52 is a hook-and-loop fastener provided on the front surface side of the projecting portion main body 41 along a direction that the projecting extension edge 411 extends.

The end connecting portion 52 and the projecting extension edge 411 are provided with a gap therebetween. As a result, the abdomen of the user is less likely to hit an upper end of a connection member, and discomfort during wearing can be reduced.

The projecting end edge 412 and the end connecting portion 52 are provided apart from each other. As a result, the end connected portion 54 is covered with the projecting portion main body 41 during use, and discomfort during wearing can be reduced.

Note that the end connecting portion 52 and the projecting extension edge 411 may be provided not to form a substantial gap therebetween. This makes it difficult for the projecting portion 4 to be visually recognized from the outside. Further, the end connecting portion 52 may project from the projecting extension edge 411.

The boundary connected portion 53 is a hook-and-loop fastener provided along a direction that second side surface edge 212 extends in a vicinity of second side surface edge 212 on the back surface side of second body main body 21.

Since the distance from the second side surface edge 212 to the boundary connected portion 53 is substantially identical to or slightly larger than the distance from the side surface edge 112 to the boundary connecting portion 51, the projecting portion 4 is less likely to be visually recognized from the outside.

By being connected in this way, a care underwear that does not give discomfort without changing an appearance and size from an original underwear is obtained.

The end connected portion 54 is a hook-and-loop fastener provided along the second top edge 211 in a vicinity of the second top edge 211 on the back surface side of the second body main body 21.

In the embodiment, on the second elastic portion 22, the end connected portions 54 are provided to be bilaterally symmetrical from the end portion of the second elastic portion 22 toward the central portion. Thus, the length of the elastic portion can be slightly adjusted.

The boundary connecting portion 51 and the end connecting portion 52 are provided at intervals as shown in FIG. 2. Preferably, the interval is 3 mm or more, more preferably 5 mm or more, and still more preferably 8 mm or more. As a result, since the projecting portion 4 can be slightly deformed in vertical and horizontal directions with respect to the second elastic portion 22, it becomes easy for the caregiver to make the user wear, the discomfort during wearing is reduced, and the hook-and-loop fastener is less likely to get off.

Hereinafter, the implementation methods of the present invention will be described in detail with reference to FIGS. 1 to 6. The present invention is implemented by a caregiver who makes a user wear the care underwear X. The following implementation method is an example, the implementation method is not limited thereto, and the order may be changed.

<<Manufacturing Method>>

The care underwear X can also be obtained by modifying ready-made underwear X'. Hereinafter, a method for manufacturing the existing underwear X' will be described in detail. It should be noted that the manufacture is performed by a maker who modifies the underwear X'.

First, as a cutting step, the maker cuts a side surface of the underwear X' along a seam. As a result, the side surface edge 112 is formed on the first body 1 side, and the second side surface edge 212 is formed on the second body 2 side.

Next, the maker cuts a cloth material into a predetermined shape, and sets the cut cloth material as the projecting portion 4. Thereafter, the maker places the projecting portion 4 such that the overlapping portion 42 overlaps the first body main body 11. At this time, at least the side surface edge 112 is made sure to be overlapped.

Thereafter, the maker joins the first body main body 11 and the overlapping portion 42 by stitching and bonding as a joining step.

<<First Use Method>>

First, as shown in FIG. 1, the caregiver spreads the care underwear X and applies the back surface of the crotch pad 3 to a crotch of the user.

Figure 3:
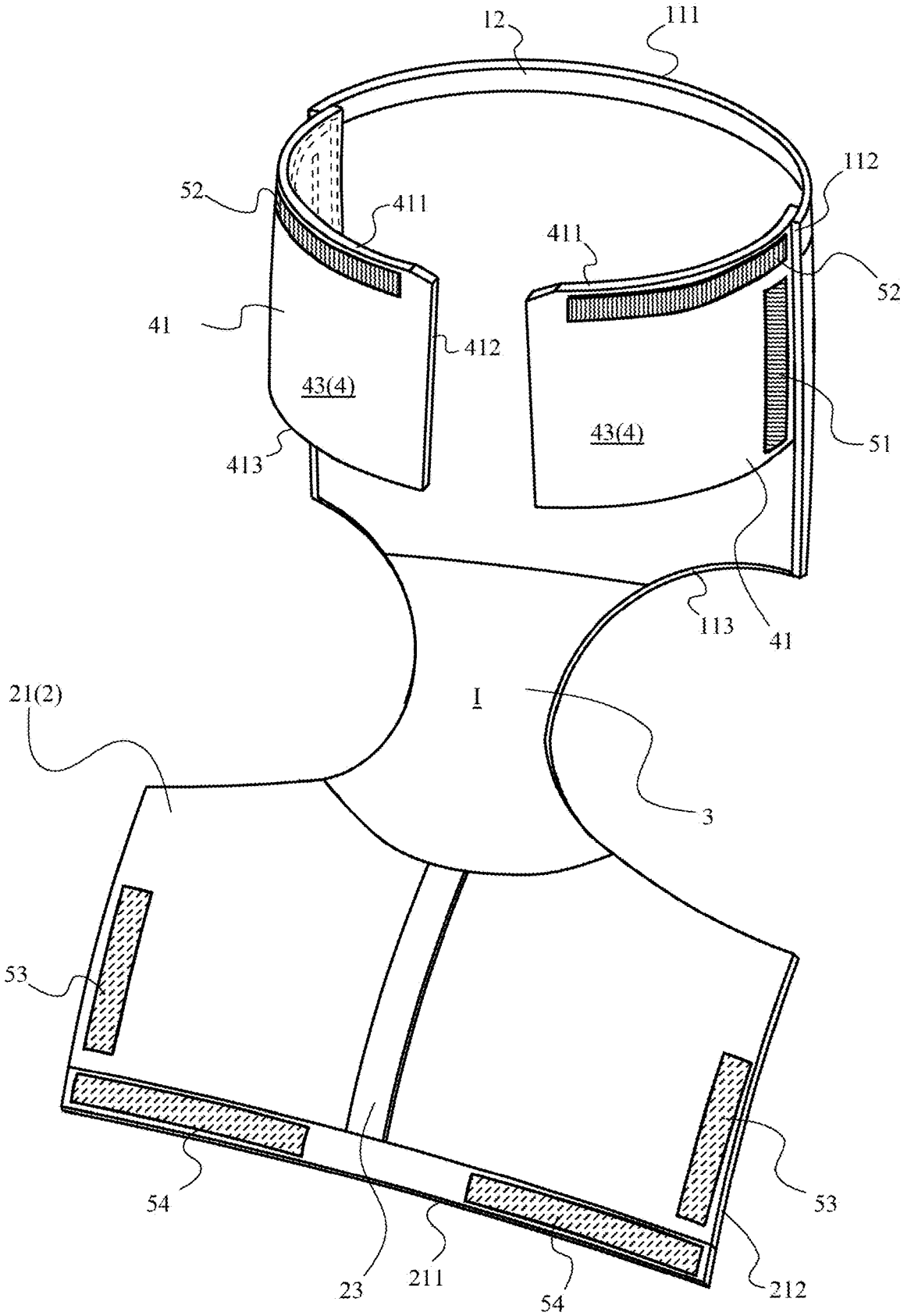
FIG. 3 is an explanatory view illustrating a connection progress of the care underwear according to the first embodiment of the present invention.
Figure 4:
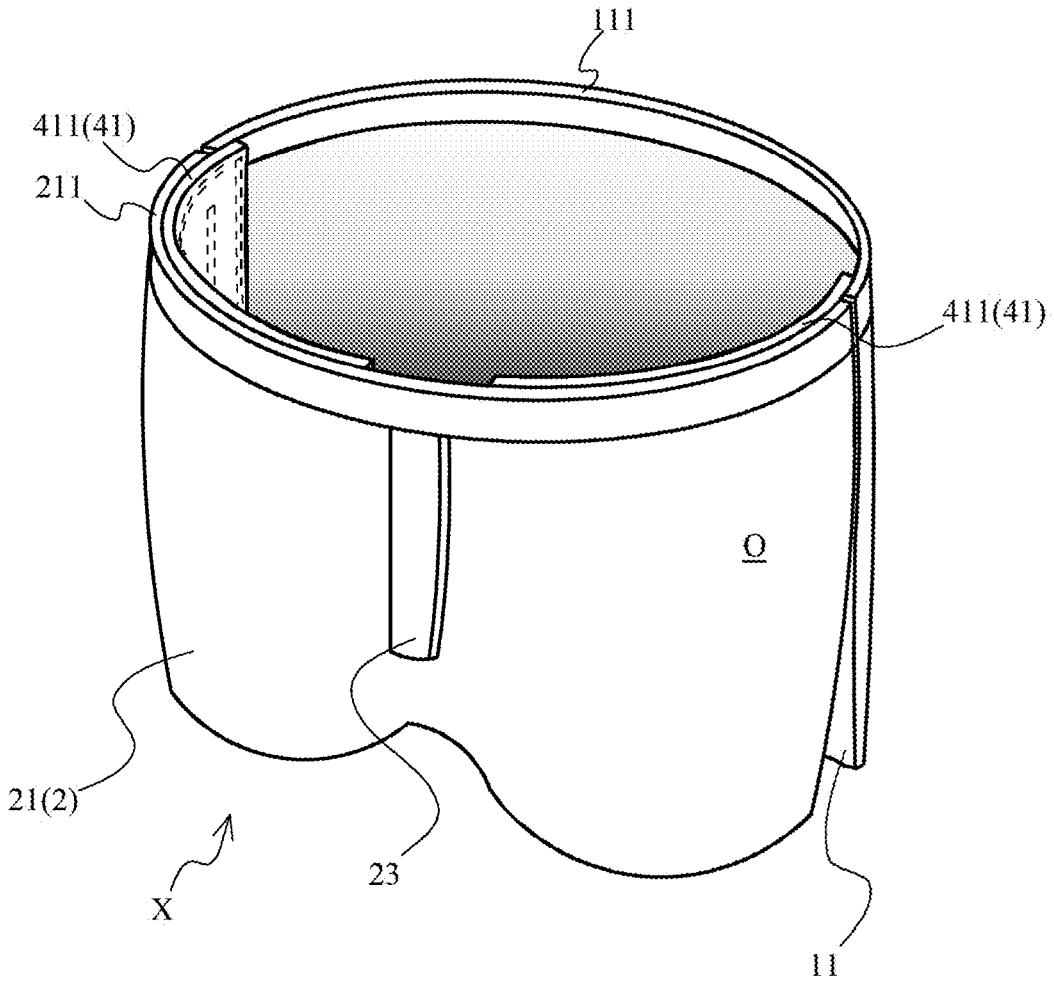
FIG. 4 is an explanatory view of the care underwear connected by a connection means according to the first embodiment of the present invention.

Next, the user deforms the projecting portion main body 41 to wrap around a waist of the user as shown in FIG. 3, thereafter, connects the boundary connecting portion 51 and the boundary connected portion 53, and connects the end connecting portion 52 and the end connected portion 54, thereby making the user wear the care underwear as shown in FIG. 4. The boundary connecting portion 51 allows the user to obtain an identical constant wearing comfort to normal underwear.

As another method, the user may grip one side of the projecting portion main body 41 and the second side surface edge 212 on the corresponding side of the second body main body 21, and bond the boundary connecting portion 51 and the boundary connected portion 53, thereafter switch a hand gripping the second side surface edge 212 to second top edge to connect the end connecting portion 52 and the end connected portion 54. Since the boundary connecting portion 51 can be roughly positioned first, it is easy to handle without requiring a force.

According to the above use method, the caregiver can make the user wear the care underwear with an appearance equivalent to normal underwear. In addition, the user can wear comfortable care underwear.

<<Second Use Method>>

As another use method of the present invention, the present invention can also be used in the following method.

First, as shown in FIG. 2, the user spreads the care underwear X and applies the front surface of the crotch pad 3 to the crotch of the user.

Figure 5:
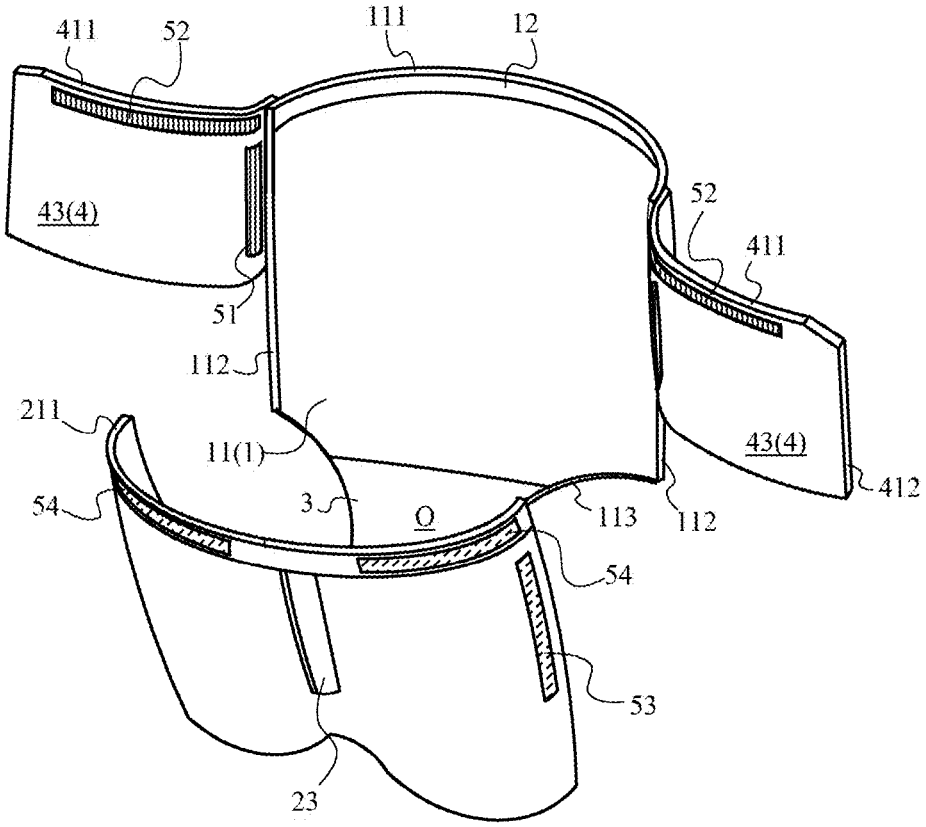
FIG. 5 is an explanatory view illustrating a connection progress of the care underwear according to another method of the first embodiment of the present invention.
Figure 6:
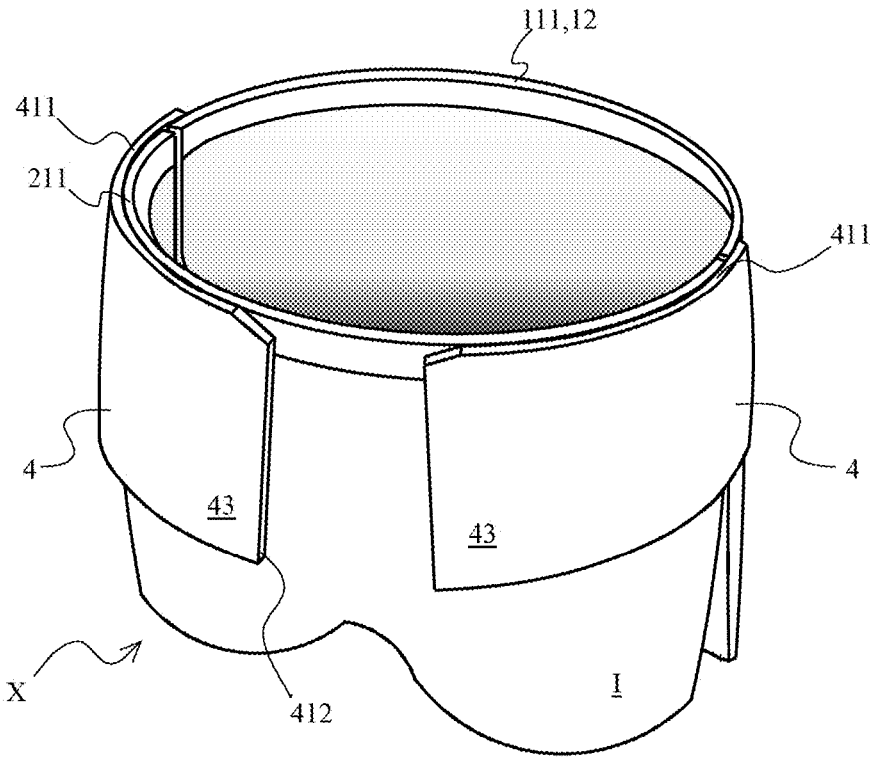
FIG. 6 is an explanatory view of the care underwear connected by a connection means according to another method of the first embodiment of the present invention.

Next, the user deforms the second body main body 21 to wind the second body main body 21 around the lower abdomen portion of the user as shown in FIG. 5, thereafter, connects the boundary connecting portion 51 and the boundary connected portion 53, and connects the end connecting portion 52 and the end connected portion 54, thereby allowing the user to wear the care underwear as shown in FIG. 6.

As described in paragraph 0047, the connection means 5 may be connected one by one.

According to the present invention, it is also possible to effectively use all the connection means by the above-described methods. As a result, the caregiver can select how to wear the care underwear that is easy for the caregiver, and the convenience in care is further enhanced.

Second Embodiment

Figure 7:
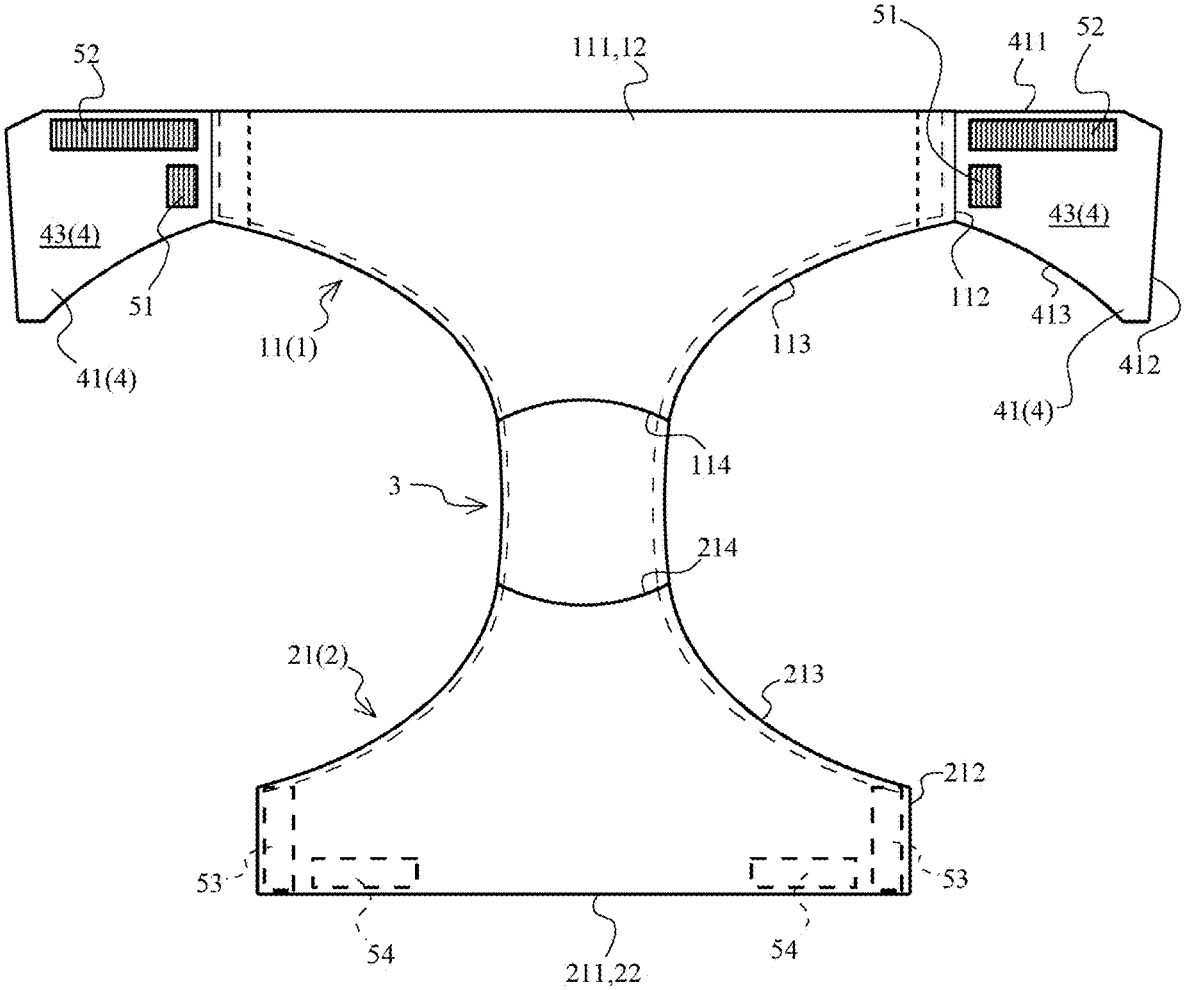
FIG. 7 is a developed view of care underwear expanded on a front surface according to a second embodiment of the present invention.
Figure 8:
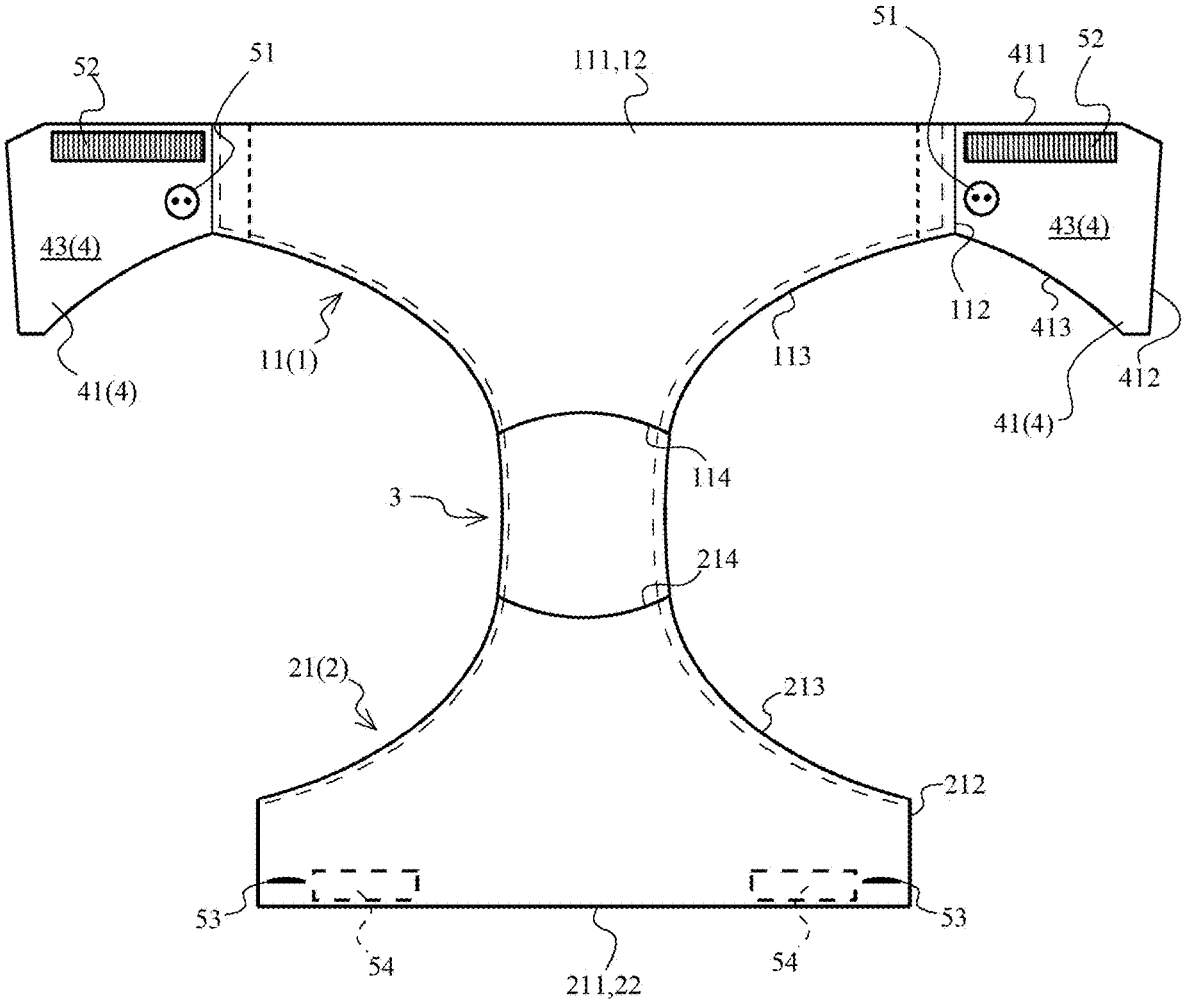
FIG. 8 is a developed view of the care underwear expanded on a front surface according to a modification of the second embodiment of the present invention.

The present invention can also be applied to female underwear as shown in FIGS. 7 and 8. Here, for an identical configuration to the configuration of the first embodiment, the same reference numerals are used, and the description thereof will be omitted.

The present invention according to the embodiment includes the first body 1, the second body 2, and the crotch pad 3, and the first body 1 further includes the projecting portion 4 projecting laterally.

The projecting portion 4 is provided with the boundary connecting portion 51 and the end connecting portion 52.

In the embodiment, a width of the first body main body 11 is larger than a width of the second body main body 21. The projecting portion 4 can be widened, and an area on the dorsal side can be expanded to improve wearing comfort.

This configuration is obtained by cutting the care underwear X on the second body 2 (front body) side as viewed from a seam connecting the first body 1 and the second body 2 in a cutting step in the method for manufacturing the care underwear X.

FIG. 8 illustrates a modification that a button is used as the boundary connecting portion 51.

The button of the boundary connecting portion 51 is disposed on the projecting portion 4 along the side surface edge 112, and is provided adjacent to the crotch pad 3 side of the end connecting portion 52 that is a hook-and-loop fastener disposed along the projecting extension edge 411. The connection means 5 may be changed to various connection methods using locking and fitting, such as a hook and a snap button.

REFERENCE SIGNS LIST

X care underwear
X' underwear
1 first body
11 first body main body
111 top edge
112 side surface edge
113 foot projecting edge
114 connection edge
12 elastic portion
2 second body
21 second body main body
211 second top edge
212 second side surface edge
213 second foot projecting edge
214 second connection edge
22 second elastic portion
23 window portion
3 crotch pad
4 projecting portion
41 projecting portion main body
411 projecting extension edge
412 projecting end edge
413 projecting bottom edge
42 overlapping portion
43 sliding portion
5 connection means
51 boundary connecting portion
52 end connecting portion
53 boundary connected portion
54 end connected portion
O front surface
I back surface

What is claimed is:

1. A care underwear comprising a first body and a second body connected to the first body, the care underwear having a front surface exposed to an outside during use and a back surface hidden on a body side, wherein the first body is cut away from the second body at a position corresponding to a side portion of the underwear, and includes projecting portions projecting laterally that are joined to the first body so as to overlap a first body main body on a back surface of the first body main body, a connection means connected to a back surface of the second body is provided on a front surface side of each of the projecting portions, the connection means includes a boundary connecting portion provided along a boundary line between the first body and the projecting portion, and on the back surface of the second body, a boundary connected portion detachably connected to the boundary connecting portion is provided along a second side surface edge that is a lateral end of the second body, and in a state where the boundary connecting portion and the boundary connected portion are connected, the first body and the second body are continuous, and the back surface covers all of the projecting portion.

2. The care underwear according to claim 1, wherein the boundary connecting portion is a belt-shaped member.

3. The care underwear according to claim 1, wherein at least one of the first body or the second body has a side surface edge which is an edge of an end portion and a window portion, the window portion being a hole penetrating through the first body or the second body and configured to allow exposing of a penis therethrough, and a distance from the side surface edge to the window portion is longer than a distance from the boundary connecting portion to an end edge of the projecting portion.

4. The care underwear according to claim 2, wherein the connection means further includes a belt-shaped end connecting portion provided along an upper end of the projecting portion, and the end connecting portion and the boundary connecting portion are provided apart from each other.

5. The care underwear according to claim 1, wherein the projecting portion includes a sliding portion that is slidable on the second body in a state where the connection means is attached.

6. The care underwear according to claim 1, wherein the connection means is a hook-and-loop fastener, and a connected means corresponding to the hook-and-loop fastener is provided at a predetermined position of the second body.

7. The care underwear according to claim 6, wherein the projecting portion covers the connected means in a state where the connection means is connected.

8. The care underwear according to claim 1, wherein a color of the projecting portion is different from a color of the first body.

9. A method for manufacturing care underwear comprising a first body and a second body connected to the first body, wherein the first body is cut away from the second body at a position corresponding to a side portion of the underwear, and includes projecting portions projecting laterally so as to overlap a first body main body on a back surface of the first body main body, a connection means connected to a back surface of the second body is provided on a front surface side of each of the projecting portions, the connection means includes a boundary connecting portion provided along a boundary line between the first body and the projecting portion, on the back surface of the second body, a boundary connected portion detachably connected to the boundary connecting portion is provided along a second side surface edge that is a lateral end of the second body, and in a state where the boundary connecting portion and the boundary connected portion are connected, the first body and the second body are continuous, and the back surface covers all of the projecting portion, the method comprising:

cutting the side portion of the underwear;

joining the projecting portions projecting laterally to the first body so as to overlap the first body main body on a back surface of the first body main body; and attaching the connection means to the front side of each of the projecting portions, which includes attaching the boundary connecting portion of the projecting portion along a boundary line between the first body and the projecting portions and detachably connecting the back surface of the second body and the boundary connected portion to the boundary connecting portion along the second side surface edge that is a lateral end of the second body.

* * * * *